United States Patent [19]

DeBruyn

[11] Patent Number: 4,720,198

[45] Date of Patent: Jan. 19, 1988

[54] HINGE BEARING INCLUDING A TAPERED PIN AND BUSHING

[75] Inventor: William DeBruyn, Rockford, Ill.

[73] Assignee: Amerock Corporation, Rockford, Ill.

[21] Appl. No.: 890,028

[22] Filed: Jul. 28, 1986

[51] Int. Cl.[4] ..... E05D 11/00

[52] U.S. Cl. ..... 384/246; 16/273; 16/381; 16/DIG. 27; 384/271

[58] Field of Search ..... 16/273, 380, 381, 386, 16/DIG. 27, 228, 263, 246, 27; 403/163, 162, 136, 140, 135; 384/246, 271; 29/11; 16/385

[56] References Cited

U.S. PATENT DOCUMENTS

| | | | |
|---|---|---|---|
| 2,972,496 | 2/1961 | Herbenar | 403/136 |
| 3,317,986 | 5/1967 | Sutowski | 29/148.4 |
| 3,625,575 | 12/1971 | Darnell | 308/3.8 |
| 3,790,195 | 5/1974 | Herbenar | 403/163 |
| 3,824,658 | 7/1974 | Donahue et al. | 29/148 |
| 4,528,718 | 7/1985 | Brockhaus | 16/386 |

FOREIGN PATENT DOCUMENTS

| | | | |
|---|---|---|---|
| 526794 | 8/1956 | Belgium | 16/386 |
| 944174 | 3/1974 | Canada | 403/135 |
| 947231 | 8/1956 | Fed. Rep. of Germany | 16/386 |
| 1435614 | 3/1966 | France | 403/162 |

*Primary Examiner*—Fred Silverberg

*Attorney, Agent, or Firm*—Leydig, Voit & Mayer, Ltd.

[57] ABSTRACT

A precision, low cost bearing for connecting the ends of two hinge links to one another for relative pivoting, the adjacent end portions of the links being formed with housings each having a socket. A spindle fixed rigidly within one of the sockets is telescoped into the other of the sockets and is formed with a taper which mates with a taper formed in the closed end portion of the latter socket. A bushing is telescoped over the spindle and into the socket and is formed with a tapered hole which mates with a second taper on the spindle. The two sets of mating tapers coact to enable the spindle to turn in the bushing with a close but free running fit in spite of diametrical and axial dimensional differences between the socket, the spindle and the bushing.

6 Claims, 4 Drawing Figures

HINGE BEARING INCLUDING A TAPERED PIN AND BUSHING

BACKGROUND OF THE INVENTION

This invention relates generally to a bearing and, more particularly, to a bearing for use in a hinge of the same general type as disclosed in DeBruyn U.S. application Ser. No. 836,248, filed Mar. 5, 1986.

The hinge disclosed in that application is a concealed hinge for mounting a cabinet door to open through a wide angle on a cabinet frame. The hinge includes two pivoted links and three pivot axes. One link is connected to pivot relative to the door about one axis, the other link is connected to pivot relative to the frame about a second axis, and the two links are connected together to pivot relative to one another about the third axis. All three axes intersect one another at a common point on the hinge axis of the door in all positions of the door and constrain the door to swing in an arc about the hinge axis while enabling wide-angle opening of the door.

In order to insure intersection of all three pivot axes at a common point on the hinge axis, it is necessary to use bearings of relatively high precision at the pivot connections of the links. Difficulty has been encountered in obtaining high precision bearings which may be manufactured and assembled at a cost sufficiently low to enable use of the bearings in a comparatively inexpensive item such as a hinge.

SUMMARY OF THE INVENTION

The general aim is to provide a relatively simple bearing which can be inexpensively manufactured without operations requiring high precision tolerances, which can be assembled quickly and easily and which, as an incident to being assembled, automatically compensates for mass production manufacturing tolerances and provides a free-running bearing having virtually zero radial or axial clearance.

A more detailed object of the invention is to provide a bearing having a housing, a spindle and a bushing formed with novel tapers which, during assembly of the bearing, coact with one another to take up relatively wide radial and axial tolerances permitted during manufacture of the three components.

The invention also resides in the provision of a relatively high precision but inexpensive bearing having sealed-in lubrication, having the ability to be plated or otherwise finished after assembly and having an outwardly projecting spindle for connecting the bearing to another member.

These and other objects and advantages of the invention will become more apparent from the following detailed description when taken in conjunction with the accompanying drawings.

DETAILED DESCRIPTION OF THE PREFERRED EMBODIMENT

Figure 1:
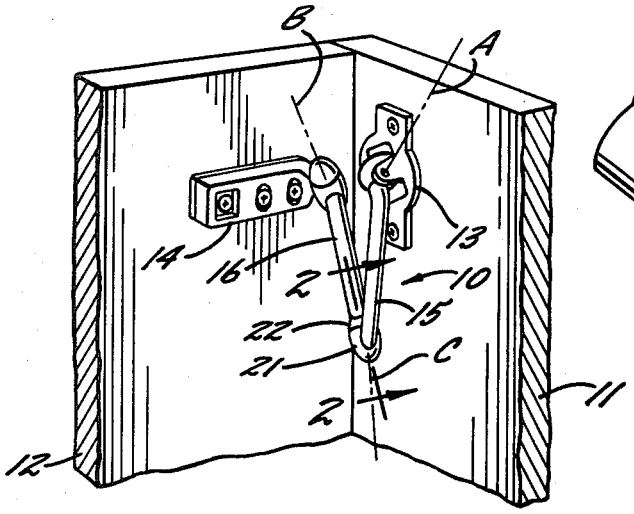
FIG. 1 is a fragmentary perspective view of a cabinet door and frame having a hinge equipped with new and improved bearings incorporating the unique features of the present invention.

For purposes of illustration, the invention is shown in the drawings in conjunction with a hinge 10 of the type disclosed in detail in the aforementioned DeBruyn application. The hinge coacts with a lower hinge (not shown) to mount an upright cabinet door 11 on a frame 12 to swing between open and closed positions about a vertical axis.

Briefly, the hinge 10 includes door and frame members 13 and 14 attached rigidly to the cabinet door 11 and frame 12, respectively. The upper end portion of a door link 15 is connected to the door member 13 to pivot thereto about an inclined axis A while the upper end portion of a frame link 16 is connected to the frame member 14 for pivotal movement about an inclined axis B. At their lower end portions, the two links are connected together to pivot relative to one another about a third axis C. The three axes A, B and C all intersect one another at a common point which lies on the vertical hinge axis of the door and which remains stationary along the hinge axis as the door is opened and closed. Reference is made to the aforementioned application for a detailed explanation of the construction, operation and advantages of the hinge 10 itself.

In order to keep the axes A, B and C intersecting at a common point at all times during movement of the door 11, it is necessary for the links 15 and 16 to be pivotally connected to one another and to the door and frame members 13 and 14 with a precision but free-running fit. In accordance with the present invention, provision is made of a bearing 20 with multiple sets of tapers which coact uniquely with one another to enable the bearing to be of high precision while at the same time permitting the bearing to be manufactured and assembled by relatively simple and low cost procedures.

The bearing 20 which has been illustrated is shown as being used to pivotally interconnect the lower end portions of the door and frame links 15 and 16. In the preferred embodiment of the hinge 10, the lower end portions of the links 15 and 16 are defined by housings 21 and 22, respectively, which coact to define a substantially egg-shaped arrangement. The housings 21 and 22 have substantially flat ends 23 and 24, respectively, which are disposed in closely spaced face-to-face relation. A generally cylindrical opening or socket 25 is formed in the housing 22 while an opening or socket 26 of special configuration is formed in the housing 21. Each socket has a closed end and is of circular cross-section throughout its length.

Figure 2:
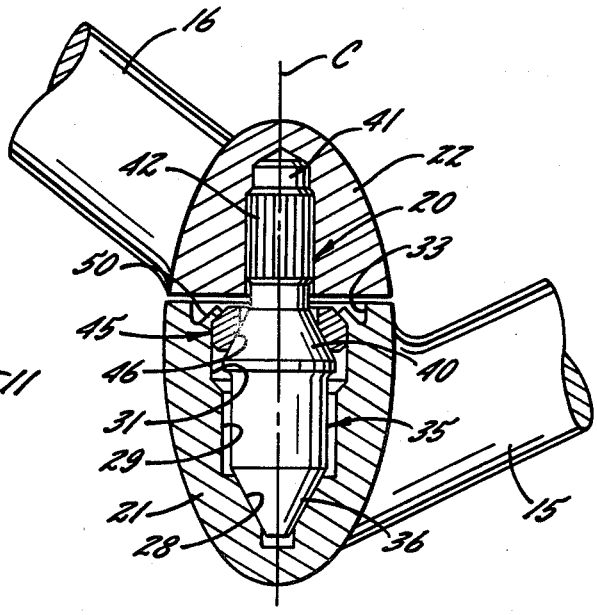
FIG. 2 is an enlarged fragmentary cross-section of one of the bearings as taken substantially along the line 2—2 of FIG. 1.
Figure 3:
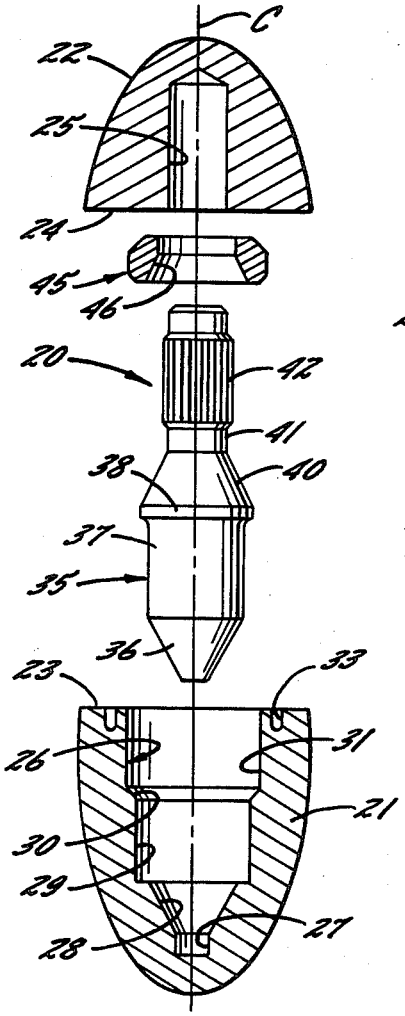
FIG. 3 is an exploded view of the components of the bearing illustrated in FIG. 2 and shows the components prior to assembly.

As shown in FIG. 3, the socket 26 is formed with a relatively small diameter cylindrical portion 27 adjacent the closed end of the socket. In keeping with the invention, the socket 26 is formed with a tapered wall portion 28 located immediately above the cylindrical portion 27. The tapered portion 28 is sloped at an angle of about 30 degrees relative to the axis of the socket 26 and diminishes in diameter as it progresses downwardly. A cylindrical portion 29 of larger diameter is located immediately above the tapered portion 28 and is followed by an axially narrow frustoconical portion 30 which, in turn, leads into a cylindrical portion 31 of still larger diameter. The latter portion opens out of the upper end 23 of the housing 21 and, as shown in FIG. 2, is encircled by a shallow annular groove 33 which also opens out of the upper end of the housing 21.

The bearing 20 further includes an elongated spindle 35 which also is of circular cross-section. Pursuant to the invention, the extreme lower end portion of the spindle is formed with a taper 36 which diminishes in diameter upon progressing downwardly. The taper 36 preferably slopes downwardly at approximately the same angle as the tapered portion 28 of the socket 26.

Located above the taper 36 is a relatively long cylindrical section 37 whose diameter is substantially less than the diameter of the cylindrical portion 29 of the socket 26. The cylindrical section 37 gradually merges with a much shorter but larger diameter cylindrical section 38 which forms a transition between the cylindrical section 37 and a second taper 40. The taper 40 is located intermediate the ends of the spindle 35 and diminishes in diameter upon progressing upwardly. In this instance, the taper 40 slopes at an angle of about 25 degrees and its major diameter is significantly less than the diameter of the cylindrical portion 31 of the socket 26.

Formed integrally with the upper end of the taper 40 is a projection or pin-like portion 41 whose diameter is somewhat less than the minor diameter of the taper 40. A straight knurl 42 is formed along and around the pin 41 between the ends thereof.

Completing the bearing 20 is a bushing 45 which is adapted to telescope into the socket 26 and over the spindle 35. The bushing may be made of hardened steel, bronze or tough, glass-filled plastic. The outer diameter of the bushing is between 0.002" and 0.006" less than the diameter of the cylindrical section 31 of the socket 26. On its inner periphery, the bushing is formed with an upwardly diminishing taper 46 which slopes at approximately the same angle as the taper 40. The extreme upper and lower end portions of the outer periphery of the bushing are chamfered as indicated at 47 and 48, respectively.

To assemble the bearing 20, the housing 21 is held in a suitable fixture. After being lubricated with a substantial quantity of grease, the spindle 35 is inserted into the socket 26 and then the bushing 45 is telescoped into the socket and over the spindle. With the components so positioned, the lower taper 36 of the spindle 35 seats against the tapered portion 28 of the socket 26 while the taper 46 of the bushing 45 seats against the upper taper 40 of the spindle. Because of the dimensional relationship between the bushing 45 and the cylindrical portion 31 of the socket 26, there initially is substantial radial clearance around the outer periphery of the bushing.

Figure 4:
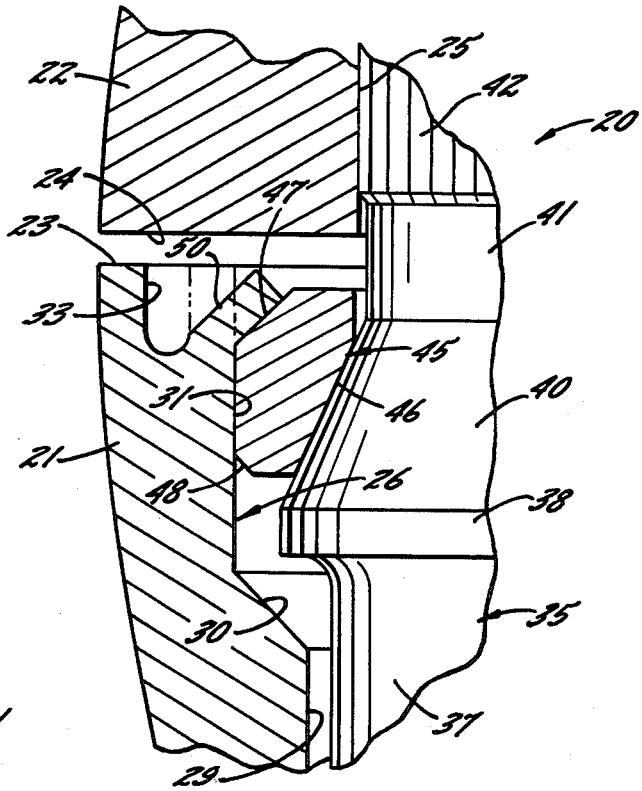
FIG. 4 is an enlarged fragmentary view of certain parts of the bearing components shown in FIG. 2.

After the housing 21, the spindle 35 and the bushing 45 have been pre-assembled as described above, a press-actuated crimping tool (not shown) is brought downwardly against the upper end 23 of the housing, enters the groove 33, and swages the inner wall of the groove inwardly over the upper chamfer 47 of the bushing to form an annular retaining flange 50 shown in FIG. 4. As the flange 50 is formed, downward force is transmitted through the flange and the bushing to the spindle. Such force causes the lower taper 36 on the spindle to become alined with and to seat tightly against the tapered portion 28 of the socket 26. At the same time, the tapered hole 46 in the bushing alines itself with and seats tightly against the upper taper 40 of the spindle 35. Tight seating of the bushing 45 against the upper taper 40 is made possible by virtue of the ample radial clearance which initially exists between the outer periphery of the bushing and the cylindrical portion 31 of the socket 26. When the flange 50 is crimped over the bushings, such clearance is taken up and is reduced virtually to zero.

After the flange 50 has first been formed, the tapers 36 and 46 are seated so tightly against the tapers 28 and 40, respectively, that the spindle 35 is essentially frozen in the housing 21 and the bushing 45. To free the spindle, a controlled downward pressure or impact is applied to the upper end of the spindle. The spindle is made of a relatively hard material (e.g., cold drawn steel) while the housing is made of a softer material such as zinc die cast alloy. When the spindle is pressed downwardly with significant force, the lower taper 36 of the hard spindle compresses the softer material in the tapered portion 28 of the housing 21 and such material yields to loosen the spindle slightly and permit free running of the spindle. In effect, the lower taper 36 acts in the manner of a coining tool to correct any mismatch between the tapers 28 and 36.

After the housing 21, the spindle 35 and the bushing 45 have been assembled, the pin 41 of the spindle may be pressed into the socket 25 of the housing 22 of the door link 16. As an incident thereto, the knurl 42 bites into the wall of the socket 25 to hold the spindle against both rotation and axial movement relative to that socket.

From the foregoing, it will be apparent that the present invention brings to the art a new and improved bearing 20 in which the mating tapers 28, 36 and 40, 46 establish a virtually zero tolerance but free running fit between the spindle 35 and the housing 21 and between the spindle and the bushing 45. The coacting tapers 28 and 36 form an outer bearing surface while the tapers 40 and 46 form an inner bearing surface. Because of the tapers, it is not necessary to hold close tolerances on the diameters or lengths of the socket 21, the spindle 35 or the bushing 45 during manufacture of these components. Close tolerances on the angles of the tapers are the only critical tolerances and such tolerances can be held with relative ease by core pins, drill points, shaving tools and the like.

The bushing 45 and the flange 50 seal the open end of the socket 26 to retain the lubricant therein for the life of the bearing 20. Because all of the critical components of the bearing are concealed, the housings 21 and 22 may be assembled to one another before the housings and the links 15 and 16 are plated or otherwise finished.

Those familiar with the art will appreciate that the spindle 35 need not necessarily be formed with the outwardly extending pin 41. Instead, the spindle could be formed with a recess for receiving a pin with a press fit. Also, the bushing 45 need not necessarily be crimped in place but could be held in the housing 21 by soldering, by cement or by other means.

I claim:

1. A bearing comprising a one-piece housing having a one-piece wall defining an opening of circular cross-section, said opening having a tapered portion and having a substantially cylindrical portion, an elongated spindle of circular cross-section having first and second ends, said housing being made of a material which is softer than the material of said spindle, said spindle having a first end portion formed with a first taper which diminishes in diameter upon progressing toward the first end of the spindle, said taper being shaped to seat against said tapered portion of said opening, a second taper formed on said spindle and diminishing in diameter upon progressing toward the second end of the spindle, a bushing telescoped into said cylindrical portion of said opening and telescoped over said spindle, the inner periphery of said bushing being formed with a taper shaped to seat against said second taper, and means captivating said bushing axially in a substantially fixed position in said opening whereby said bushing holds said spindle axially in a substantially fixed position in said opening by virtue of engagement of the taper of said bushing with the second taper of said spindle.

2. A bearing as defined in claim 1 in which said means comprise a flange integral with said housing adjacent one end of said opening and bent into engagement with said bushing.

3. A bearing as defined in claim 2 in which the end of said opening adjacent the first end of said spindle is completely closed whereby said opening defines a socket with a completely closed end.

4. A bearing as defined in claim 3 in which an elongated projection is formed integrally with the second end portion of said spindle and extends outwardly out of the open end of said socket.

5. A bearing comprising a one-piece housing made of metal and defining a socket with a completely closed end and an opposite open end, said socket being of circular cross-section and being formed with a tapered portion adjacent the closed end of the socket and with a generally cylindrical portion adjacent the open end of the socket, said tapered portion diminishing in diameter upon progressing toward the closed end of the socket, an elongated spindle of circular cross-section and made of a metal which is harder than the metal of said housing, said spindle having a first end located adjacent the closed end of said socket and having a first end portion formed with a first taper which diminishes in diameter upon progressing toward the first end of the spindle, said taper being shaped to seat against the tapered portion of said socket, a second taper formed on said spindle between the ends thereof and tapered oppositely of said first taper, a bushing telescoped into the cylindrical portion of said socket and telescoped over said spindle, the inner periphery of said bushing being shaped to seat against said second taper, a portion of said housing adjacent the open end of said socket being deformed inwardly into engagement with said bushing to captivate said bushing in a substantially axially fixed position in said socket, said tapered portion and said bushing coacting with said first and second tapers, respectively, to hold said spindle against any substantial axial movement in said housing.

6. A bearing as defined in claim 5 in which an elongated projection is formed integrally with the second end portion of said spindle and extends outwardly out of the open end of said socket.

* * * * *